US006254418B1

(12) United States Patent
Tharp et al.

(10) Patent No.: US 6,254,418 B1
(45) Date of Patent: Jul. 3, 2001

(54) LATCH RELEASE

(75) Inventors: Keith Franklin Tharp, San Jose; Timothy Mark Scarano, Hayward, both of CA (US)

(73) Assignee: The JPM Company, Lewisburg, PA (US)

( * ) Notice: Subject to any disclaimer, the term of this patent is extended or adjusted under 35 U.S.C. 154(b) by 0 days.

(21) Appl. No.: 09/639,782

(22) Filed: Aug. 16, 2000

(51) Int. Cl.[7] ..... H01R 13/627
(52) U.S. Cl. ..... 439/352
(58) Field of Search ..... 439/344, 352, 439/354

(56) References Cited

U.S. PATENT DOCUMENTS

| | | | | |
|---|---|---|---|---|
| 4,272,145 | * | 6/1981 | LaDuke | 439/358 |
| 4,647,826 | | 3/1987 | Ota | 318/561 |
| 4,925,398 | * | 5/1990 | Samejima et al. | 439/357 |
| 4,995,826 | | 2/1991 | Schieferly | 439/347 |
| 5,203,719 | * | 4/1993 | Kozono | 439/489 |
| 5,207,593 | | 5/1993 | Bogeil | 439/352 |
| 5,255,154 | | 10/1993 | Hosoi et al. | 361/680 |
| 5,399,109 | | 3/1995 | Sedig | 439/701 |
| 5,462,457 | * | 10/1995 | Schroepfer et al. | 439/736 |
| 5,613,869 | * | 3/1997 | Erlich et al. | 439/344 |
| 5,725,324 | | 3/1998 | Pavelski | 403/321 |
| 5,755,587 | * | 5/1998 | Sakai et al. | 439/352 |
| 5,785,540 | | 7/1999 | Jaklin | 439/157 |
| 5,941,726 | | 8/1999 | Koegel et al. | 439/358 |
| 5,947,776 | | 9/1999 | Epe | 439/752 |
| 6,071,141 | | 6/2000 | Semmeling et al. | 439/353 |
| 6,089,898 | | 7/2000 | Lincoln, III et al. | 439/357 |

* cited by examiner

*Primary Examiner*—Khiem Nguyen
*Assistant Examiner*—Thanh-Tam Le
(74) *Attorney, Agent, or Firm*—Duane, Morris & Heckscher LLP

(57) ABSTRACT

The invention provides a latch release for engaging an operative portion of a latching mechanism of a connector to switch the latching mechanism between a latched position and an unlatched position. In one embodiment, a latch release is provided comprising a housing that is cooperatively associated with the connector so as to be positioned adjacent to the operative portion of the latching mechanism. A beam is pivotably supported by the housing and comprises a front end positioned adjacent to the operative portion of the latching mechanism and a rear end that is spaced from the operative portion of the latching mechanism. In this way, when the rear end of the beam is moved, the beam pivots so that the front end operatively engages the operative portion of the latching mechanism. In another embodiment of the invention, the latch release comprises a beam pivotably supported by the housing and comprising a front end positioned adjacent to the operative portion of the latching mechanism, a rear end that is spaced from the operative portion of the latching mechanism and a resilient hinge located between the front and rear ends. In this embodiment, when the rear end of the beam is moved, the beam pivots flexing the living hinge thereby moving the front end into operative engagement with the operative portion of the latching mechanism. In yet another embodiment of the invention, the latch release comprises a cam slidably supported by the housing and comprising a front end positioned adjacent to the operative portion of the latching mechanism and including a camming surface and a rear end that is spaced from the operative portion of the latching mechanism. In this embodiment, when the rear end of the cam is slid toward the latching mechanism the camming surface operatively engages the operative portion of the latching mechanism.

17 Claims, 10 Drawing Sheets

LATCH RELEASE

FIELD OF THE INVENTION

The present invention generally relates to electrical connectors, and more particularly to devices adapted for the actuation of locking latches.

BACKGROUND OF THE INVENTION

Electrical connectors typically have a multiplicity of terminal contacts positioned in an insulating housing, and arranged so as to be connected to a complementary connector to form a connector pair. It is well known to use mechanical latching mechanisms for maintaining the connection between the two connectors. The latching mechanism will ensure that the mating connectors maintain an electrical connection. Typically, the connector includes an integral latch member which is secured to the housing by a leg or biased hinge, or a connection point with the housing of the connector. The mating connector has a catch or a lug which will engage the latch mechanism when the two connectors are interengaged thereby ensuring that the connectors remain secured together. Examples of connectors utilizing such devices may be found in U.S. Pat. Nos.: 6,089,898; 6,071,141; 5,947,776; 5,941,726; 5,785,540; 5,725,324; 5,399,109; 5,255,154; 5,207,593; 4,995,826; 4,647,128; and 4,272,145.

These arrangements are not always satisfactory, especially when they are used in conjunction with multiple, but separate connectors that are positioned either side-by-side or stacked one above the other.

There is a need in the art for connectors that can be released from one another when the latching mechanism is located in a remote position, or in an arrangement with other connector pairs that provides little or no space for actuation. This need in the art has become acute in connection with many "high density" interconnection systems, where unlatching must take place under difficult circumstances, e.g., in a blind space where several such connectors are arranged in a stacked configuration.

SUMMARY OF THE INVENTION

The present invention provides a latch release for engaging an operative portion of a latching mechanism of a connector to switch the latching mechanism between a latched position and an unlatched position. In one embodiment, a latch release is provided comprising a housing that is cooperatively associated with the connector so as to be positioned adjacent to the operative portion of the latching mechanism. A beam is pivotably supported by the housing and comprises a front end positioned adjacent to the operative portion of the latching mechanism and a rear end that is spaced from the operative portion of the latching mechanism. In this way, when the rear end of the beam is moved, the beam pivots so that the front end operatively engages the operative portion of the latching mechanism.

In another embodiment of the invention, a latch release is provided comprising a beam pivotably supported by the housing and comprising a front end positioned adjacent to the operative portion of the latching mechanism, a rear end that is spaced from the operative portion of the latching mechanism and a resilient hinge located between the front and rear ends. In this embodiment, when the rear end of the beam is moved, the beam pivots, flexing the living hinge, and thereby moving the front end into operative engagement with the operative portion of the latching mechanism.

In yet another embodiment of the invention, a latch release is provided comprising a cam slidably supported by the housing and comprising a front end positioned adjacent to the operative portion of the latching mechanism and including a camming surface and a rear end that is spaced from the operative portion of the latching mechanism. In this embodiment, when the rear end of the cam is slid toward the latching mechanism the camming surface operatively engages the operative portion of the latching mechanism.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
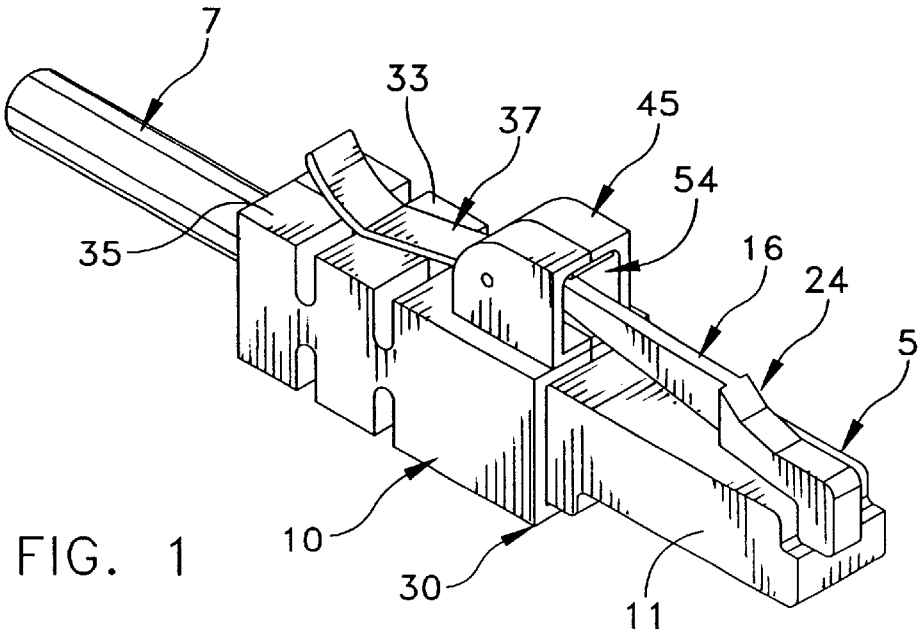
FIG. 1 is a perspective view of a latch release formed according to an embodiment of the invention, and assembled to an electrical connector including a terminated cable.
Figure 2:
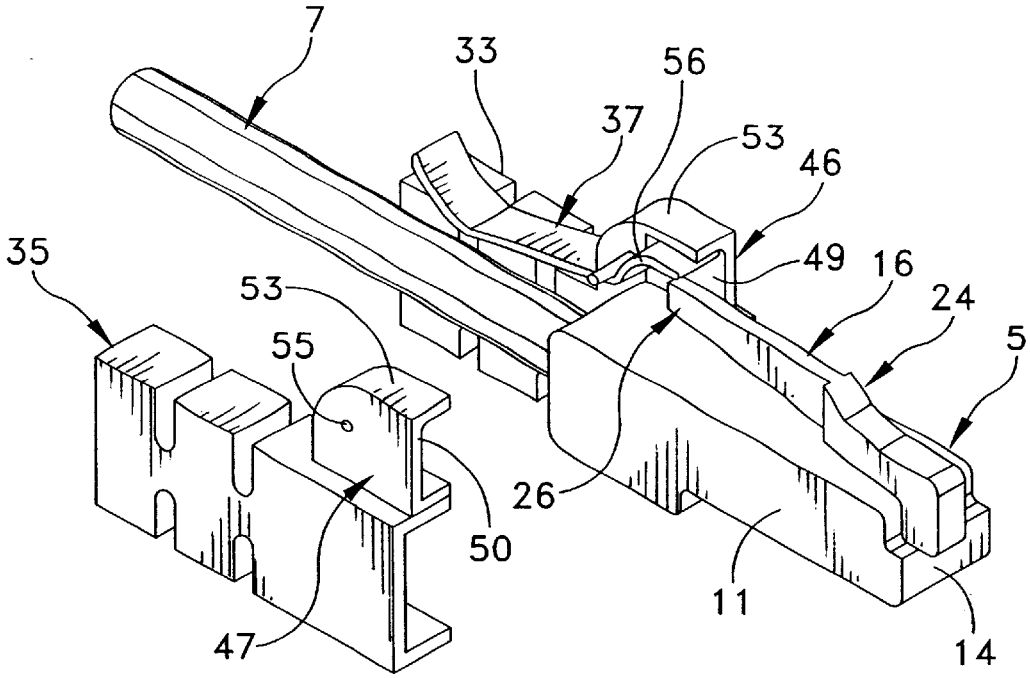
FIG. 2 is a partially exploded, perspective view of the assembly shown in FIG. 1.

This description of preferred embodiments is intended to be read in connection with the accompanying drawings, which are to be considered part of the entire written description of this invention. In the description, relative terms such as "horizonal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

FIGS. 1–6 show an electrical connector 5 that is terminated to the end of a cable 7 and supporting a latch release 10 formed in accordance with one embodiment of the present invention. More particularly, electrical connector 5 may comprise any of the well known high density interconnection devices that are known in the art. Connectors of this type typically include a plurality of closely spaced, electrically conductive pin or receptacle contacts (not shown) arranged within an insulative housing 11, and individually terminated at one end to a corresponding plurality of conductors (not shown) that form the central portion of cable 7. The electrical interconnection features of the plurality of closely spaced pin or receptacle contacts are positioned adjacent to an interface surface 14 of the connector.

Housing 11 of electrical connector 5 is typically formed from one of the well known polymer materials that are suitable for injection molding, e.g., polyhalo-olefins, polyamides, polyolefins, polystyrenes, polyvinyls, polyacrylates, polymethacrylates, polyesters, polydienes, polyoxides, polyamides, polycarbonates, polyterephthalates, and polysulfides and their blends, co-polymers and substituted derivatives thereof. Housing 11 also normally includes a resilient latch 16 having an operative portion positioned on an outer surface, and arranged to releasably engage a corresponding feature on a mating electrical connector (not shown) that may be, e.g., mounted on the edge of a printed wiring board or terminated to the end of another cable, or the like. Latch 16 may comprise various known shapes and include several alternative features that are adapted for releasably engaging a corresponding feature on the mating electrical connector, e.g., recesses, notches, shoulders, catches, or tabs, etc. FIGS. 1–16 show a representative latch 16 that includes a catch 24 that is adapted to engage a corresponding recess, or the like (not shown) on a mating connector.

Typically, latch 16 will comprise a cantilevered beam that is fixed, via a living hinge 21 or the like. For example, in the embodiments shown in FIGS. 1–16, latch 16 extends rearwardly from interface surface 14 toward cable 7, and at an acute angle relative to the top surface of housing 11. In this way, depressing latch 16 toward the top surface of housing 11 stores elastic energy in living hinge 21 so that when released, latch 16 springs away from the top surface of housing 11 and toward its original unloaded position. Of course, the various embodiments of the latch release of the present invention, and their obvious variations, are not limited in any way to the latch arrangement shown in the figures, but may be advantageously used in connection with many other arrangements of latches and connectors.

Terminal end 26 of latch 16 may include various known features that are adapted for aiding in depressing latch 16, and are arranged so that a finger 27 or tool may depress terminal end 26 to release latch 16 from engagement with the mating connector. For example, when connectors are mated together latch 16 may be depressed, thus disengaging catch 24 from a corresponding recessed portion (not shown) on the mating connector. However, due to the high density requirements placed on such connectors, little or no space is available for the application of a person's finger or tool to depress latch 16 and thereby release connector 5 from its corresponding mating connector, as intended by the design. This situation is often acute in applications that require a plurality of interconnection devices to be engaged to the same device in a closely spaced architecture, e.g., mounted both side-by-side and/or in stacked formation, and arranged with minimal clearance between adjacent connectors or other structures.

Figure 3:
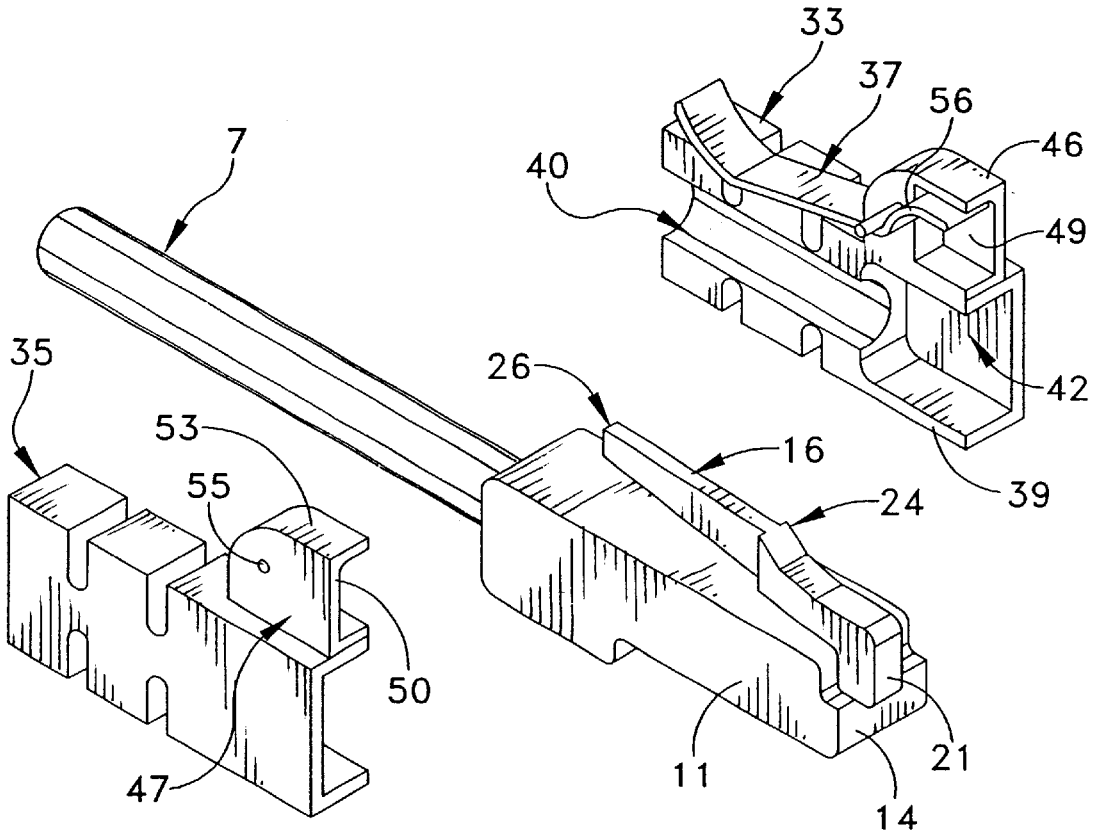
FIG. 3 is an exploded perspective view of the assembly shown in FIG. 1.

The present invention solves this problem in the art by providing latch release 10 that is adapted to slip over a rear portion of electrical connector 5 so as to provide an easily accessible means for engaging and depressing latch 16 of electrical connector 5. More particularly, one embodiment of latch release 10 comprises a boot 30 having a first half 33, a second half 35, and a toggle beam 37 pivotably assembled between first and second halves 33,35 (FIG. 3). First half 33 and second half 35 each comprise concavely shaped, complementary body portions that are typically formed from any of the well-known polymer materials disclosed hereinabove in connection with housing 11 of electrical connector 5. Halves 33,35 are designed to mate along a peripheral edge 39 so as to form boot 30. It has been found to be advantageous, although not required, to form boot 30 so as to be symmetric about a central dividing line (corresponding to peripheral edges 39) so that halves 33,35 are mirror images of one another.

An internal recess 40 of halves 33,35 is shaped so as to be complementary with the outer profile of cable 7 and another internal recess 42 of halves 33,35 is shaped so as to be complementary with the outer profile of housing 11 of electrical connector 5. In this way, when halves 33,35 are mated together to form boot 30, i.e., brought into engagement with one another so that their respective peripheral edges 39 engage in aligned relationship, a central, open-ended passageway is formed within boot 30 that is sized and shaped to contain and cooperate with both a portion of housing 11 of electrical connector 5 and a portion of cable 7. When assembled for use, boot 30 is positioned in overlying relation with electrical connector 5 and cable 7 so that a portion of cable 7 is located within internal recess 40, and a portion of electrical connector 5 is located within internal recess 42.

A cowl 45 projects from an outer surface of boot 30, and is formed from cowlhalves 46,47 that are formed on corresponding outer surfaces of boot halves 33,35, respectively. Cowl 45 comprises walls 49,50 and a radiused outer wall 53. Through-bores 55,56 are formed in walls 49,50 at a position where they will be aligned in coaxial relation to one another when boot 30 is assembled from boot halves 33,35. Cowl 45 defines a first open end 59 and a second open end 60. First open end 59 is generally larger than second open end 60, and is located adjacent to an open end of the central passageway within boot 30 that is formed by a portion of internal recess 42. Second open end 60 is located between a portion of radiused outer wall 53 and an outer surface of boot 30. As a result of this arrangement, when boot 30 is assembled to electrical connector 5, a portion of terminal end 26 of latch 16 extends into first open end 59 and the interior of cowl 45.

Figure 4:
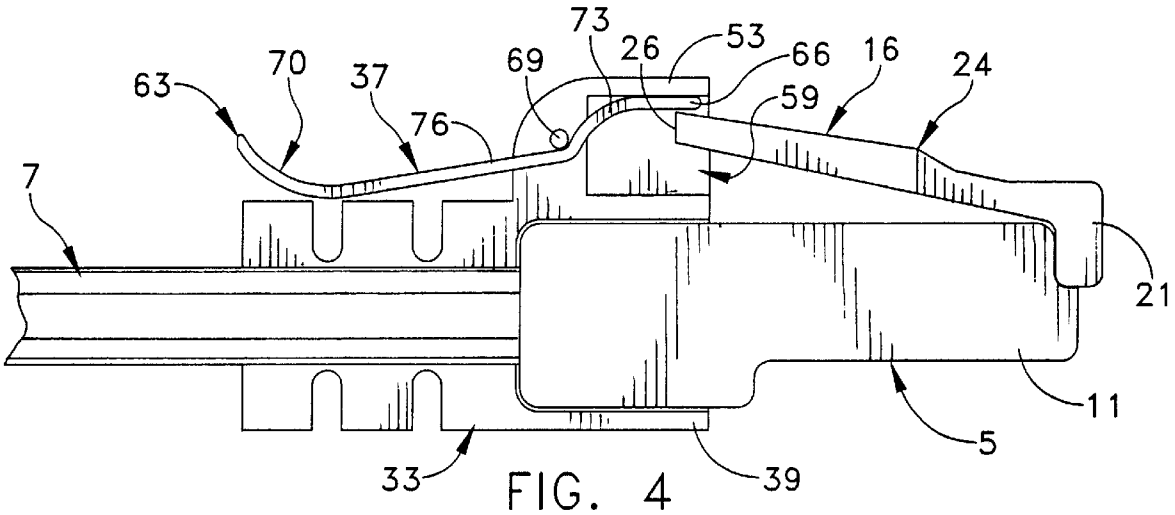
FIG. 4 is a side elevational view of the assembly shown in FIG. 2.
Figure 5:
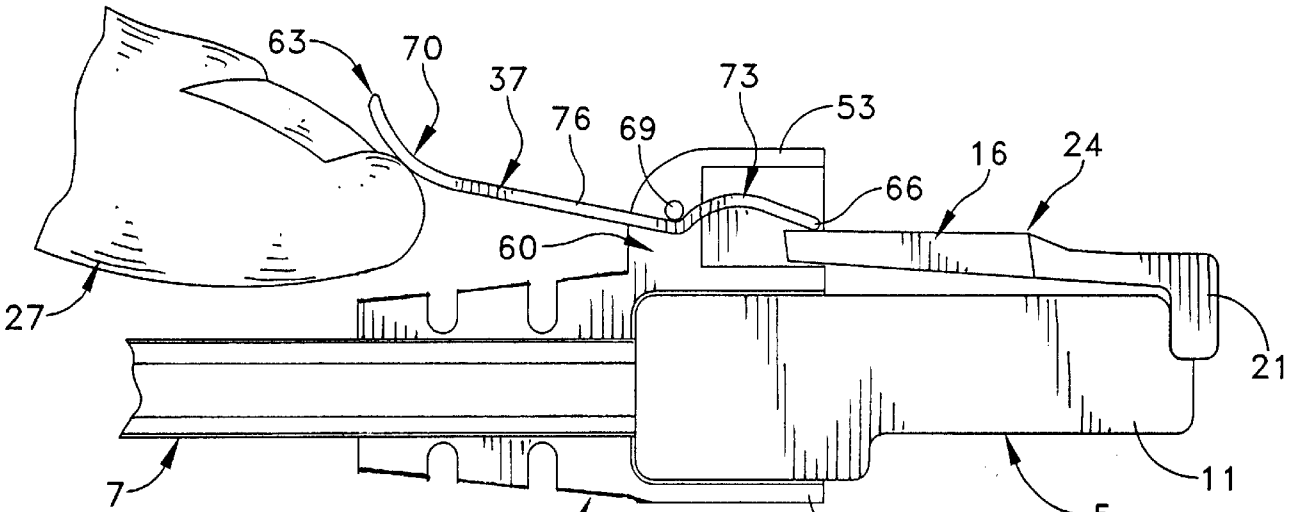
FIG. 5 is a side elevational view, similar to that shown in FIG. 4, showing a finger actuating a toggle beam portion of the latch release according to the invention.
Figure 6:
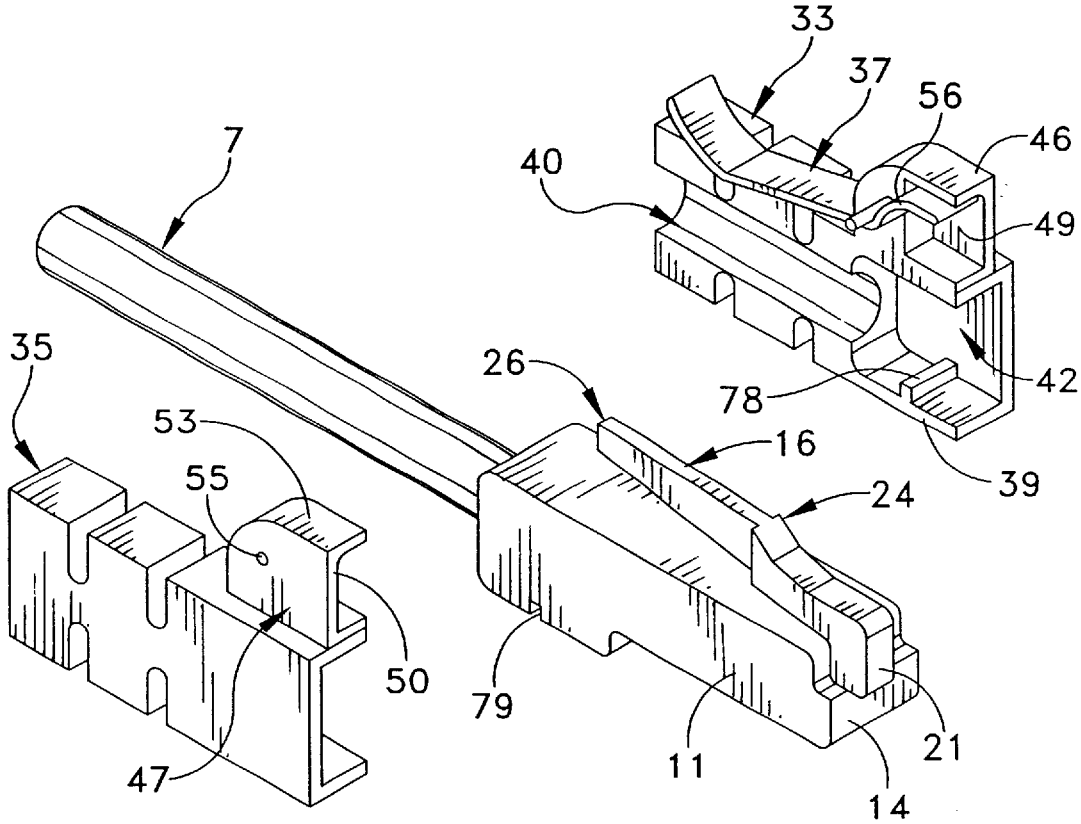
FIG. 6 is an exploded perspective view of the assembly similar to that shown in FIG. 1, including a boot retention feature.

Referring to FIGS. 4 and 5, toggle beam 37 comprises an elongate beam having a first end 63, a second end 66, and a pivot axle 69. More particularly, first end 63 includes an angled or radiused section 70, that is sized and shaped for engagement with an operative portion of a tool or finger 27. In the embodiment shown in FIGS. 1–6, first end 63 is radiused so as to curve outwardly relative to the longitudinal axis of toggle beam 37 and away from the outer surface of boot 30. Second end 66 includes a latch engagement section 73 that is spaced from first end 63 and radiused section 70 by a substantially elongate and rigid section 76. Pivot axle 69 comprises a substantially round shaft that projects outwardly from each lateral edge of toggle beam 37, in perpendicular relation to rigid section 76, and has a diameter sized to be received within through-bores 55,56 of cowl 45. In the embodiment shown in FIGS. 1–6, pivot axle 69 is positioned eccentrically along section 76 of toggle beam 37 so as to be adjacent to a rear portion of latch engagement section 73. Toggle beam 37 is assembled to boot 30 such that latch engagement section 73 is positioned within cowl 45 and adjacent to terminal end 26 of latch 16, with pivot axle 69 rotatably positioned within through-bores 55,56, and first end 63 and radiused portion 70 extending outwardly and away from second open end 60 of cowl 45 (FIGS. 4 and 5).

In this way, when radiused portion 70 of toggle beam 37 is lifted, e.g., by sliding finger 27 or a tool between it and the outer surface of boot 30, toggle beam 37 pivots about pivot axle 69, thereby moving latch engagement section 73 downwardly into contact with terminal end 26 of latch 16 (FIG. 5). As this occurs, latch 16 bends toward housing 11 of electrical connector 5 with elastic energy being stored in living hinge 21. This action, in turn, tends to bias latch 16 outwardly, away from electrical connector 5. With latch 16 disposed in this biased state, electrical connector 5 may be pulled from engagement with its mating connector (not shown). Thus the present invention allows for the easy actuation of latch 16 when electrical connector 5 is mated in a high density interconnection architecture, e.g., when mounted either side-by-side, in stacked formation, and/or in any combination with minimal clearance between adjacent connectors or other structures.

Various modifications to the present invention will become obvious to those skilled in the art upon review of the appended claims. For example, and now referring to FIG. 6, a boot retention means, such as shoulder 78, may be formed in a portion of halves 33,35, with a corresponding mating recess 79 formed in a portion of electrical connector 5. In this way, a secure engagement between boot 30 and electrical connector 5 may be maintained. Additionally, it has been found to be advantageous to taper the rear portion of boot 30, as shown in FIG. 5, so as to provide for clearance between finger 27 and boot 30 during actuation of toggle beam 37. Also, it will be understood that although boot 30 has been described as being formed from halves 33,35, a single piece boot may also be used without departing from the scope of the present invention. Of course, other structures and forms of retention feature and boot will be suggested by this disclosure to those skilled in the art, and may also be used in connection with the invention with equal effect.

Figure 7:
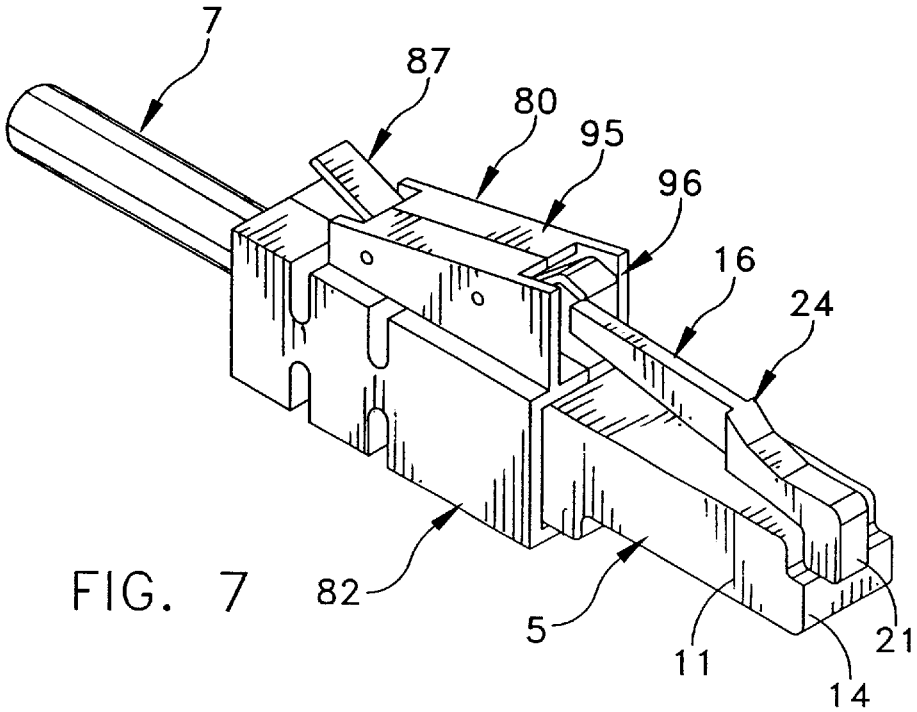
FIG. 7 is a perspective view of a latch release formed according to an alternative embodiment of the invention, and assembled to an electrical connector including a terminated cable.
Figure 8:
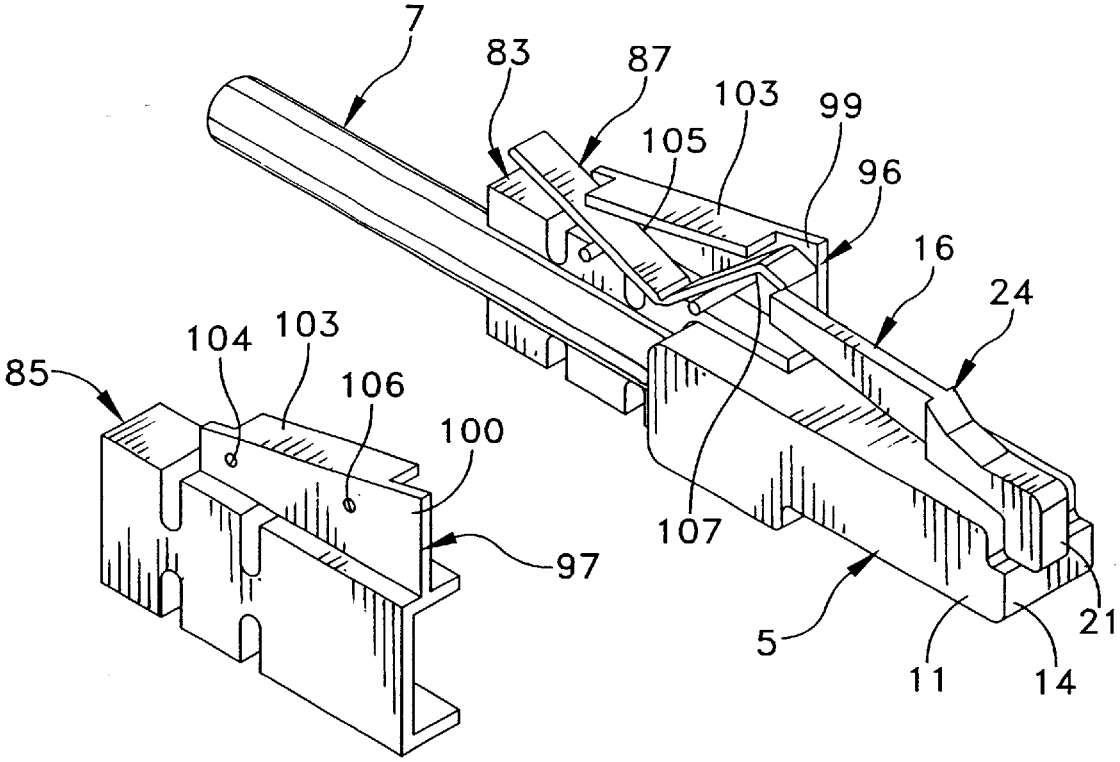
FIG. 8 is a partially exploded, perspective view of the assembly shown in FIG. 7.
Figure 9:
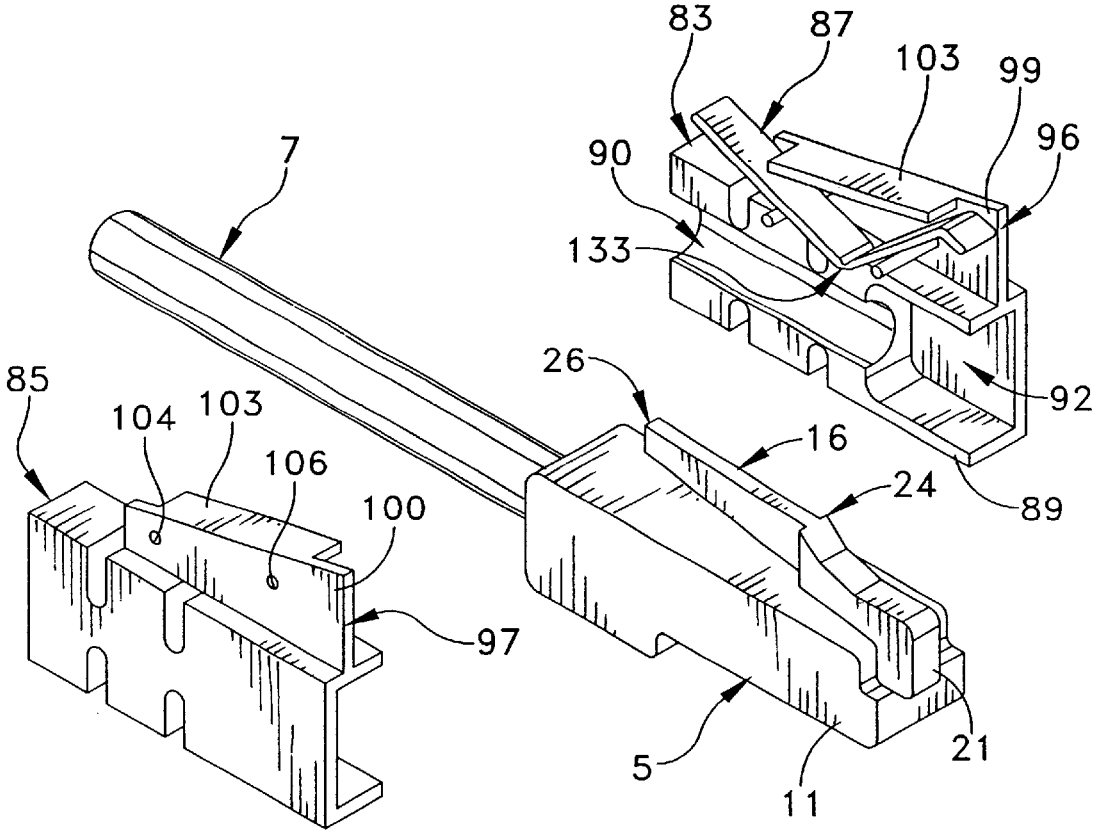
FIG. 9 is an exploded perspective view of the assembly shown in FIG. 8.

Referring to FIGS. 7–11, an alternative embodiment of the present invention includes latch release 80 comprising a boot 82 having a first half 83, a second half 85, and a hinge-beam 87. Hinge-beam 87 is operatively assembled between first and second halves 83,85 (FIGS. 8 and 9). First half 83 and second half 85 are similar to halves 33,35, inasmuch as each comprise concavely shaped, complementary body portions that are typically formed from any of the well-known polymer materials disclosed hereinabove in connection with housing 11. Halves 83,85 are designed to mate along a peripheral edge 89 so as to form boot 82. It has also been found to be advantageous, although not required, to form boot 82 so as to be symmetric about a central dividing line (corresponding to peripheral edges 89) so that halves 83,85 are mirror images of one another.

An internal recess 90 of halves 83,85 is shaped so as to be complementary with the outer profile of cable 7 and another internal recess 92 of halves 83,85 is shaped so as to be complementary with the outer profile of electrical connector 5. In this way, when halves 83,85 are mated together to form boot 82, i.e., brought into engagement with one another so that their respective peripheral edges 89 engage in aligned relationship, a central, open-ended passageway is formed within boot 82 that is sized and shaped to contain and cooperate with both a portion of housing 11 of electrical connector 5 and a portion of cable 7. When assembled for use, boot 82 is positioned in overlying relation with electrical connector 5 and cable 7 so that a portion of cable 7 is located within internal recess 90, and a portion of electrical connector 5 is located within internal recess 92.

A cowl 95 projects from an outer surface of boot 82, and is formed from cowlhalves 96,97 that are formed on corresponding outer surfaces of boot halves 83,85, respectively. Cowl 95 comprises walls 99,100 and an outer wall 103. Through-bores 104,105 and 106,107 are formed in walls 99,100 at a position where through-bores 104,105 will be aligned in coaxial relation to one another and through-bores 106,107 will be aligned in coaxial relation to one another, when boot 82 is assembled from boot halves 83,85. Cowl 95 defines a first open end 109 and a second open end 110. First open end 109 is generally larger than second open end 110, and is located adjacent to an open end of the central passageway within boot 82 formed by a portion of internal recess 92. Second open end 110 is located between a portion of outer wall 103 and an outer surface of boot 82. As a result of this arrangement, when boot 82 is assembled to electrical connector 5, a portion of terminal end 26 of latch 16 extends into open end 109 and the interior of cowl 95.

Hinge-beam 87 comprises an elongate beam having a first end 113, a second end 116, and a pair of pivot axles 119,120. More particularly, first end 113 may be flat or may include an angled or radiused section, that is shaped and sized for engagement with an operative portion of a tool or finger 27. In the embodiment shown in FIGS. 7–11, first end 113 is flat so as to extend outwardly relative to the longitudinal axis of hinge-beam 87. Second end 116 includes a latch engagement section 126 that is spaced from first end 113 by a substantially elongate and semi-rigid section 130. More particularly, a resilient, living hinge 133 is formed in a portion of semi-rigid section 130 in such a way that semi-rigid section 130 may be biased, upwardly or downwardly, with elastic energy being stored in living hinge 133.

Pair of pivot axles 119,120 comprise substantially round shafts that project outwardly from the lateral edges of hinge-beam 87 in perpendicular relation to semirigid section 130, and have a diameter sized to be received within through-bores 104,105 and 106,107 of cowl 95, respectively. In the embodiment shown in FIGS. 7–11, pivot axles 119, 120 are positioned in spaced relation to one another, and to living hinge 133, so that pivot axle 119 is adjacent to a front portion of first end 113 and pivot axle 120 is adjacent to a rear portion of latch engagement section 126. Hinge-beam 87 is assembled to boot 82 such that latch engagement section 126 is positioned within cowl 95 and adjacent to terminal end 26 of latch 16, with pivot axles 119,120 rotatably positioned within through-bores 104,105 and 106, 107, and first end 113 extending through second open end 110 of cowl 95 (FIGS. 8–11). In this configuration, it is often advantageous to locate through-bores 104,105 and 106,107 in off-set relation to one another, such that when hinge-beam 87 is mounted within cowl 95, pivot axle 120 is raised relative to pivot axle 119 (FIGS. 7 and 8).

Figure 10:
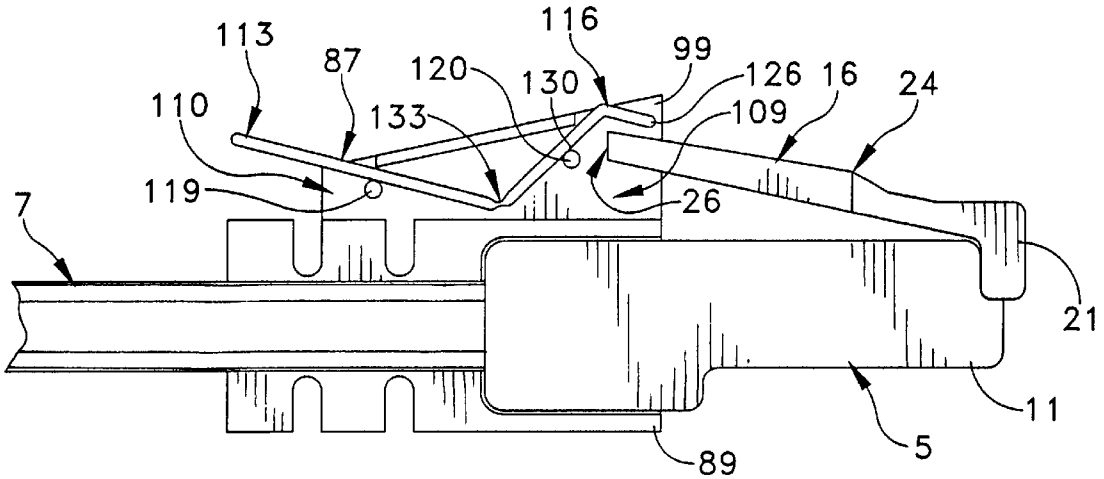
FIG. 10 is a side elevational view of the assembly shown in FIG. 8.
Figure 11:
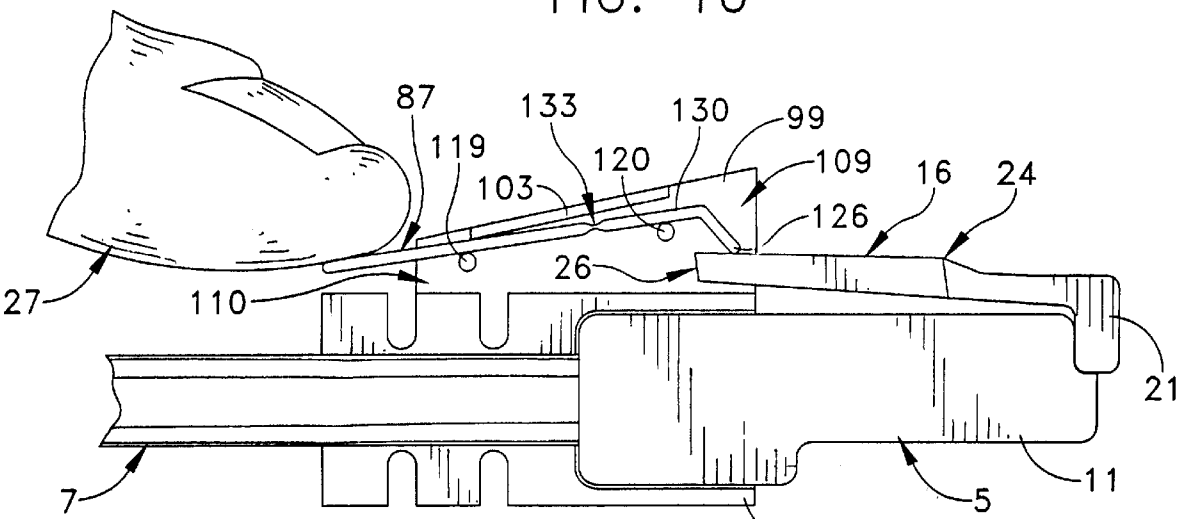
FIG. 11 is a side elevational view, similar to that shown in FIG. 10, showing a finger actuating a hinge-beam portion of the latch release according to an alternative embodiment of the invention.
Figure 12:
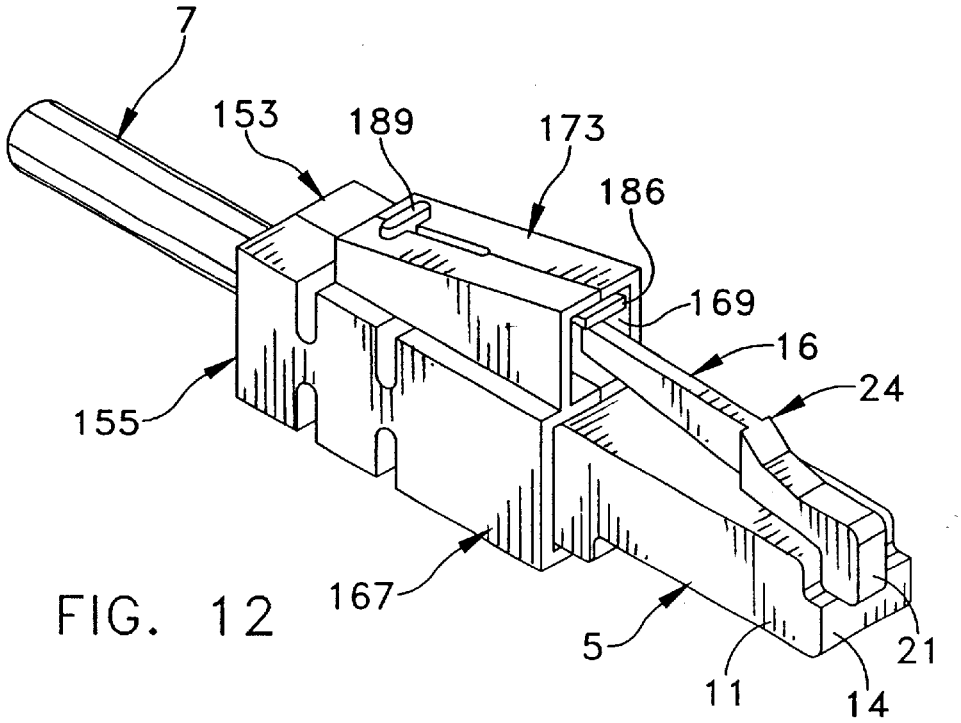
FIG. 12 is a perspective view of a latch release formed according to another alternative embodiment of the invention, and assembled to an electrical connector including a terminated cable.

Thus, when first end 113 of hinge-beam 87 is depressed, e.g., by sliding finger 27 or a tool over top of it and pressing toward the outer surface of boot 82, living hinge 133 pivots upwardly, about pivot axles 119,120, thereby moving second end 116 and latch engagement section 126 downwardly into contact with terminal end 26 of latch 16 (FIGS. 10 and 11). As this occurs, latch 16 bends toward housing 11 of electrical connector 5 with elastic energy being stored in living hinge 21. This, in turn, tends to bias latch 16 outwardly, away from electrical connector 5. This alternative embodiment of the present invention allows for the easy actuation of latch 16 when electrical connector 5 is mated in a high density interconnection architecture, e.g., when mounted either side-by-side, in stacked formation, and/or in any combination with minimal clearance between adjacent connectors or other structures.

Figure 13:
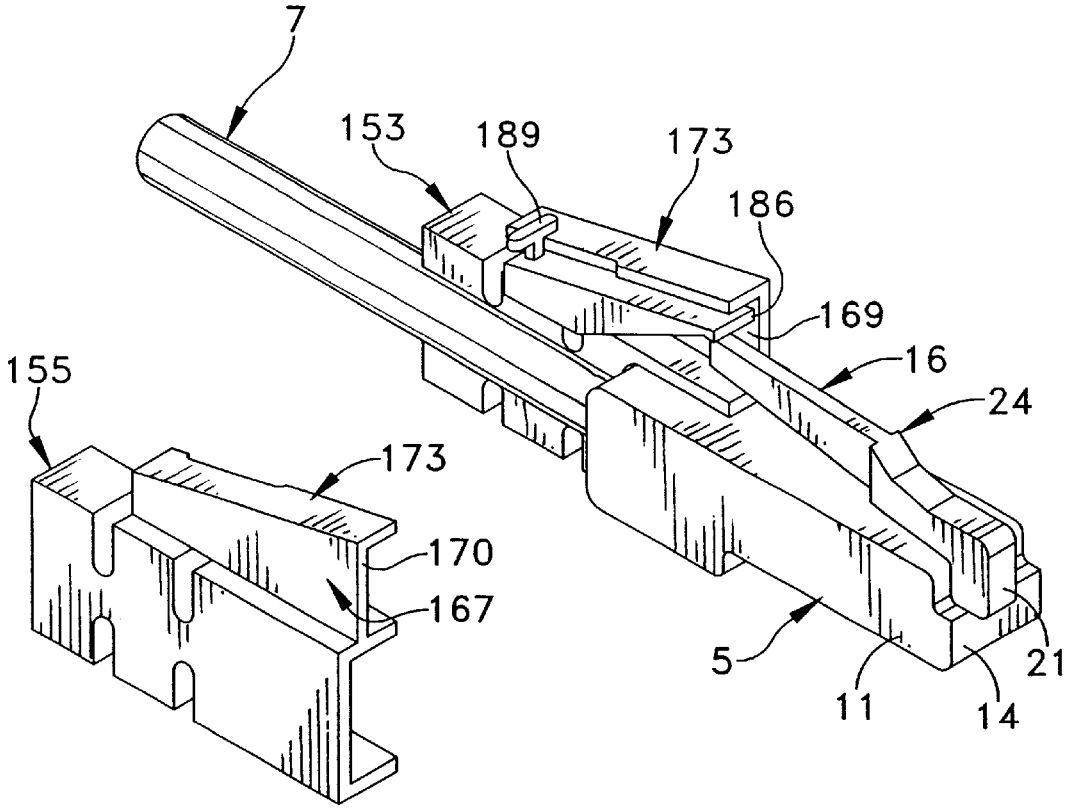
FIG. 13 is a partially exploded, perspective view of the assembly shown in FIG. 12.
Figure 14:
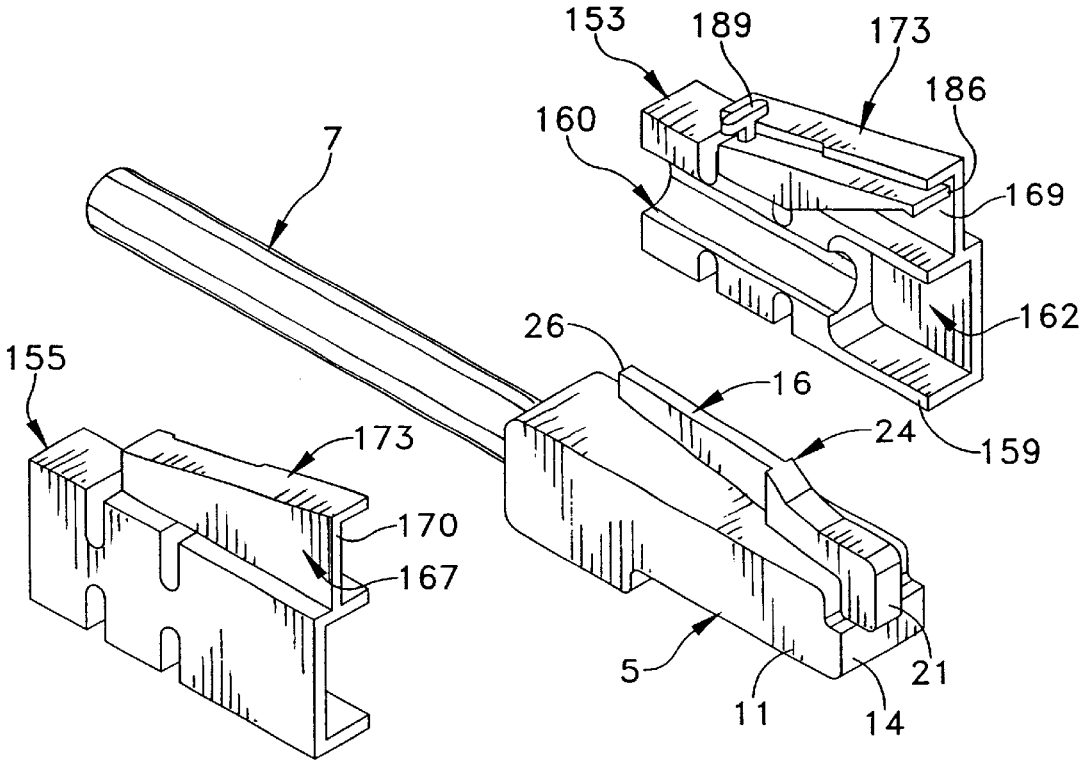
FIG. 14 is an exploded perspective view of the assembly shown in FIG. 12.

Referring to FIGS. 12–16, in a further alternative embodiment of the present invention latch release 150 comprises a boot 152 having a first half 153, a second half 155, and a slide 157 operatively assembled between first and second halves 153,155 (FIGS. 13 and 14). First half 153 and second half 155 are similar to halves 33,35 and 83,85, inasmuch as each comprise concavely shaped, complementary body portions that are typically formed from any of the well-known polymer materials disclosed hereinabove in connection with housing 11. Halves 153,155 are designed to mate along a peripheral edge 159 so as to form boot 152. It has also been found to be advantageous, although not required, to form boot 152 so as to be symmetric about a central dividing line (corresponding to peripheral edges 159) so that halves 153,155 are mirror images of one another.

An internal recess 160 of halves 153,155 is shaped so as to be complementary with the outer profile of cable 7 and another internal recess 162 of halves 153,155 is shaped so as to be complementary with the outer profile of electrical connector 5. In this way, when halves 153,155 are mated together to form boot 152, i.e., brought into engagement with one another so that their respective peripheral edges 159 engage in aligned relationship, a central, open-ended passageway is formed within boot 152 that is sized and shaped to contain and cooperate with both a portion of housing 11 of electrical connector 5 and a portion of cable 7. When assembled for use, boot 152 is positioned in overlying relation with electrical connector 5 and cable 7 so that a portion of cable 7 is located within internal recess 160, and a portion of electrical connector 5 is located within internal recess 162.

A cowl 165 projects from an outer surface of boot 152, and is formed from cowlhalves 166,167 that are formed on corresponding outer surfaces of boot halves 153,155, respectively. Cowl 165 comprises walls 169,170 and an outer wall 173. A slot 175 is formed along a portion of peripheral edge 159 of outer wall 173 when boot 152 is assembled from boot halves 153,155. Cowl 165 defines a first open end 179 and a second end 180. First open end 179 is generally larger than second end 180, and is located adjacent to an open end of the central passageway within boot 152 formed by a portion of internal recess 160. Second end 180 may be open or closed, and is located between a portion of outer wall 173 and an outer surface of boot 152. As a result of this arrangement, when boot 152 is assembled to electrical connector 5, a portion of terminal end 26 of latch 16 extends through first open end 179 into the interior of cowl 165.

Slide 157 comprises an elongate beam having a first end 183, a second end 186, and a push/pull tab 189. More particularly, first end 183 may be rectangularly shaped or may have another cross-sectional shape that is complementary to the internal shape of cowl 165. Second end 186 includes a latch engagement section 193 that is spaced from first end 183 by a substantially elongate and semi-rigid section 190. Latch engagement section 193 includes a camming surface 196 comprising an inclined or radiused wall. In the embodiment shown in FIGS. 12–16, push/pull tab 189 projects outwardly from the top surface of slide 157 so as to extend through slot 175 of cowl 165. When slide 157 is assembled to boot 152, latch engagement section 193 is positioned within cowl 165, with camming surface 196 positioned adjacent to terminal end 26 of latch 16.

Figure 15:
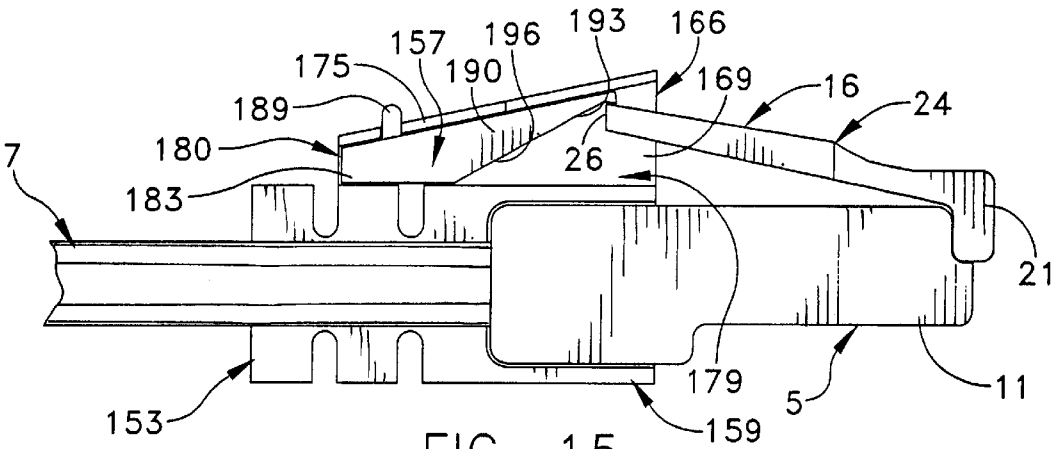
FIG. 15 is a side elevational view of the assembly shown in FIG. 12.
Figure 16:
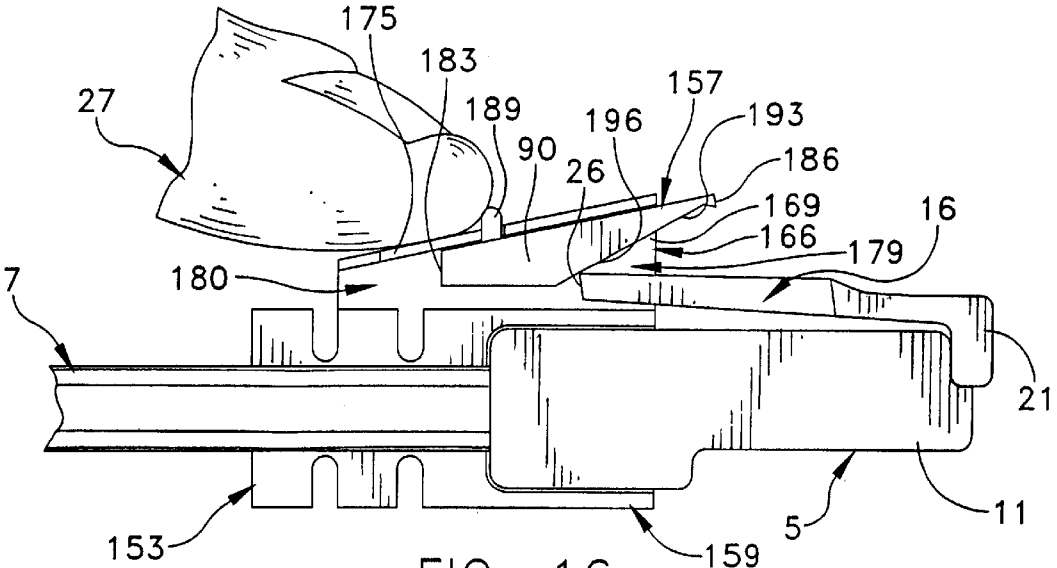
FIG. 16 is a side elevational view, similar to that shown in FIG. 12, showing a finger actuating a slide beam of the latch release according to an alternative embodiment of the invention.

Thus, when first end 183 of slide 157 is moved forwardly, by pushing upon tab 175 with finger 27 or tool, slide 157 moves latch engagement section 193 into contact with terminal end 26 of latch 16 (FIGS. 13,15 and 16). As this occurs, camming surface 196 engages and slides along terminal end 26 of latch 16 which causes latch 16 to bend toward housing 11 of electrical connector 5 with elastic energy being stored in living hinge 21. This, in turn, tends to bias latch 16 outwardly, away from electrical connector 5. Thus this alternative embodiment of the present invention allows for the easy actuation of latch 16 when electrical connector 5 is mated in a high density interconnection architecture, e.g., when mounted either side-by-side, in stacked formation, and/or in any combination with minimal clearance between adjacent connectors or other structures.

It is to be understood that the present invention is by no means limited only to the particular constructions herein disclosed and shown in the drawings, but also comprises any modifications or equivalents within the scope of the claims.

What is claimed is:

1. A latch release for engaging an operative portion of a latching mechanism of a connector so as to switch said latching mechanism between a latched position and an unlatched position comprising:

a housing cooperatively associated with said connector so as to be positioned adjacent to said operative portion of said latching mechanism said housing including a cowl projecting from an outer surface and having a first wall and a second wall arranged in spaced apart relation to one another with each of said first and second walls defining a through-bore that is positioned in aligned in coaxial relation; and a beam comprising a pivot axle received within said through-bores of said housing so as to be pivotably supported between said first and said second walls, said beam comprising a front end positioned adjacent to said operative portion of said latching mechanism and a rear end that is spaced from said operative portion of said latching mechanism so that when said rear end of said beam is moved, said beam pivots so that said front end operatively engages said operative portion of said latching mechanism.

2. A latch release according to claim 1 wherein said beam comprises a first end including a radiused section that is sized and shaped for engagement by said operative portion of at least one of a tool and a finger, and a second end including a latch engagement section that is spaced from said first end with said pivot axle positioned therebetween.

3. A latch release according to claim 2 wherein said first end is radiused so as to curve outwardly and away from said housing.

4. A latch release according to claim 2 wherein said pivot axle is positioned eccentrically along said beam so as to be adjacent to a rear portion of said latch engagement section.

5. A latch release according to claim 2 wherein said latch engagement section is positioned within said cowl and adjacent to said latch mechanism.

6. A latch release according to claim 5 wherein when radiused portion of said beam is lifted by sliding a finger between said beam and said housing said beam pivots about said pivot axle thereby moving said latch engagement section downwardly into contact with an operative portion of said latching mechanism latch.

7. A latch release according to claim 1 wherein said housing includes a tapered section located adjacent to said rear end of said beam.

8. A latch release for engaging an operative portion of a latching mechanism of a connector so as to switch said latching mechanism between a latched position and an unlatched position comprising:

a housing cooperatively associated with said connector so as to be positioned adjacent to said operative portion of said latching mechanism and including a cowl projecting from an outer surface and having a first wall and a second wall arranged in spaced apart relation to one another with each of said first and second walls defining a pair of through-bores that are positioned in aligned in coaxial relation; and a beam comprising a pair of spaced apart pivot axles and a living hinge positioned therebetween wherein said pivot axles of said beam are received within said through-bores and thereby pivotably supported between said first and said second walls said beam comprising a front end positioned adjacent to said operative portion of said latching mechanism, a rear end that is spaced from said operative portion of said latching mechanism and a resilient hinge located between said front and rear ends so that when said rear end of said beam is moved, said beam pivots flexing said living hinge and thereby moving said front end into operative engagement with said operative portion of said latching mechanism.

9. A latch release according to claim 8 wherein said beam comprises a first end including a radiused section that is sized and shaped for engagement by said operative portion of at least one of a tool and a finger, and a second end including a latch engagement section that is spaced from said first end with said pivot axles and said living hinge positioned therebetween.

10. A latch release according to claim 9 wherein said first end extends outwardly away from said cowl in spaced relation to said housing.

11. A latch release according to claim 9 wherein said pivot axles are positioned in off-set relation to one another along said cowl.

12. A latch release according to claim 9 wherein said latch engagement section is positioned within said cowl and adjacent to said latch mechanism.

13. A latch release according to claim 12 wherein when said first end of said beam is depressed said living hinge moves relative to said pivot axles thereby moving said latch engagement section downwardly into contact with an operative portion of said latching mechanism latch.

14. A latch release for engaging an operative portion of a latching mechanism of a connector so as to switch said latching mechanism between a latched position and an unlatched position comprising:

a housing cooperatively associated with said connector so as to be positioned adjacent to said operative portion of said latching mechanism and including a cowl projecting from an outer surface and having a first wall and a second wall arranged in spaced apart relation to one another with an outer wall positioned between said first and second walls and in spaced relation to said housing; and a cam slidably supported between said first and said second walls of said housing and comprising a front end positioned adjacent to said operative portion of said latching mechanism and including a camming surface, a rear end that is spaced from said operative portion of said latching mechanism so that when said rear end of said cam is slid toward said latching mechanism said camming surface operatively engages said operative portion of said latching mechanism.

15. A latch release according to claim 14 wherein said outer wall defines a slot and said cam comprises a push tab projecting outwardly from said slot.

16. A latch release according to claim 14 wherein and said beam comprises a first end including a camming surface is sized and shaped for sliding and operative engagement with an operative portion of said latching mechanism.

17. A latch release according to claim 16 wherein said camming surface is positioned within said cowl and adjacent to said latch mechanism.

* * * * *